US005941628A

United States Patent [19]

Chang

[11] Patent Number: 5,941,628

[45] Date of Patent: Aug. 24, 1999

[54] LAMP-HOLDER FOR DECORATIVE NETWORK TYPE LIGHT

[76] Inventor: Chih-Chen Chang, No. 32, Kuang Hua South Street, Hsinchu City, Taiwan

[21] Appl. No.: 08/996,820

[22] Filed: Dec. 23, 1997

[51] Int. Cl.[6] ..... F21V 21/00

[52] U.S. Cl. ..... 362/249; 362/226; 362/391; 362/457; 439/456; 439/574

[58] Field of Search ..... 439/449, 456, 439/574; 362/226, 249, 250, 252, 258, 391, 457, 458

[56] References Cited

U.S. PATENT DOCUMENTS

| | | | |
|---|---|---|---|
| 2,662,220 | 12/1953 | Saari | 439/574 |
| 3,927,315 | 12/1975 | Werry | 362/249 |
| 4,841,420 | 6/1989 | Baggio et al. | 362/391 |
| 4,888,671 | 12/1989 | Reimer | 362/250 |
| 4,918,576 | 4/1990 | Farrall et al. | 362/250 |
| 4,959,761 | 9/1990 | Critelli et al. | 362/226 |
| 5,531,411 | 7/1996 | Adams | 362/391 |
| 5,672,000 | 9/1997 | Lin | 362/249 |
| 5,730,522 | 3/1998 | Wyke et al. | 362/457 |
| 5,775,802 | 7/1998 | Kuo | 362/249 |

*Primary Examiner*—Alan Cariaso
*Attorney, Agent, or Firm*—Rosenberg, Klein & Bilker

[57] ABSTRACT

The present invention relates to a lamp-holder for decorative network light, in which a main body of lamp-holder with two pairs of T-shaped slots opposite for both T-shaped pegs of a U-shaped lug sliding in and locating to fasten the cords in. In practicing, sliding out the U-shaped lugs, then inserting the cord into the slot, final sliding back in the original position to fix the cord on the main body integrally.

2 Claims, 3 Drawing Sheets

LAMP-HOLDER FOR DECORATIVE NETWORK TYPE LIGHT

BACKGROUND OF THE INVENTION

1. Field of the Invention

The present invention relates to a decorative light, and more particularly to a lamp-holder for decorative network type light.

2. Description of the Prior Art

In accordance with the conventional decorative network type Christmas light, as shown on FIG. 3, which includes of a lamp-holder 5, cords 3, lamp 4 and a flexible plastic tube 7 used into fastening all parts in place. In practicing, as using the flexible plastic tube 7 to fasten the cords 3 and the lamp-holder 5 together so that the lamp-holder 5 can be located into a certain position of the network, it has to pass over the lamp-holders 5 and cords 3 one by one respectively in order to put over the lamp-holder 5 to locate the cord 3 inversely. In this way, the assembly not only takes much time but also due to undergoing exposed into the out air for a long time, the plastic material is became into qualitative change so as to fall off. Therefore a new lamp-holder, as shown on FIG. 4 came out, in which the lamp-holder 8 is an integrated body with two C-shaped lugs 9 have to coordinate with the outer diameter of the cords so as to fit together tightly and to prevent offsetting so the assembly demands much time and work for threading the cords through the C-shaped lugs 9 with a low production efficiency.

OBJECTS AND SUMMARY OF THE INVENTION

It is therefore a main object of the present invention to provide a lamp-holder for decorative network light that not only concerns the U-shaped lugs integrated with the lamp-holder and also convenience for threading the cords simultaneously.

This object is achieved by a main body with two pairs of T-shaped slots of lamp-holder opposite for both T-shaped pegs of a U-shaped lug sliding in and locating to fasten the cords in. In practicing, sliding out the U-shaped lugs, then putting the cord into the inner portion 22, final sliding back into the original position to fix the cord on the main body integrally.

DETAILED DESCRIPTION OF PREFERRED EMBODIMENTS

Figure 1:
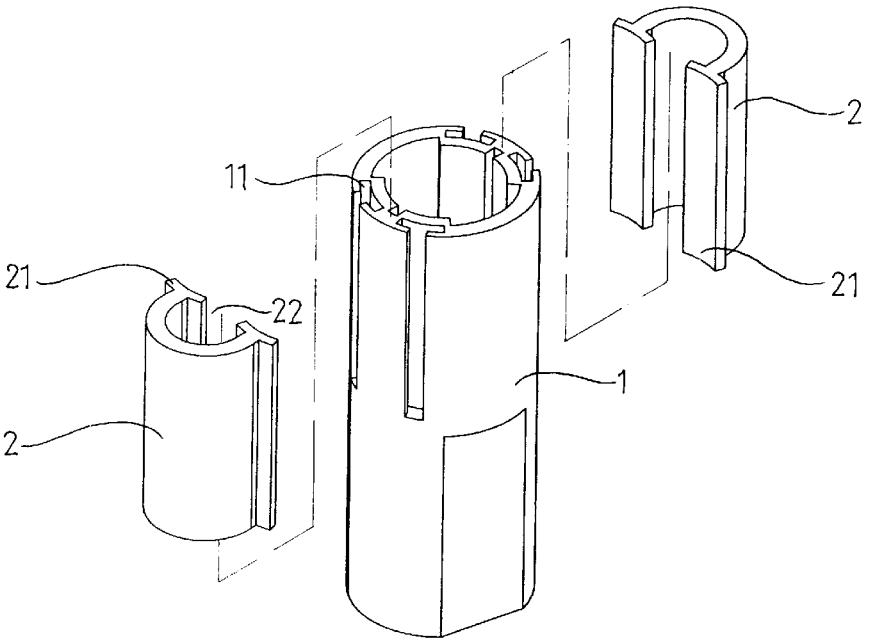
FIG. 1 is an exploded view of the present invention.
Figure 2:
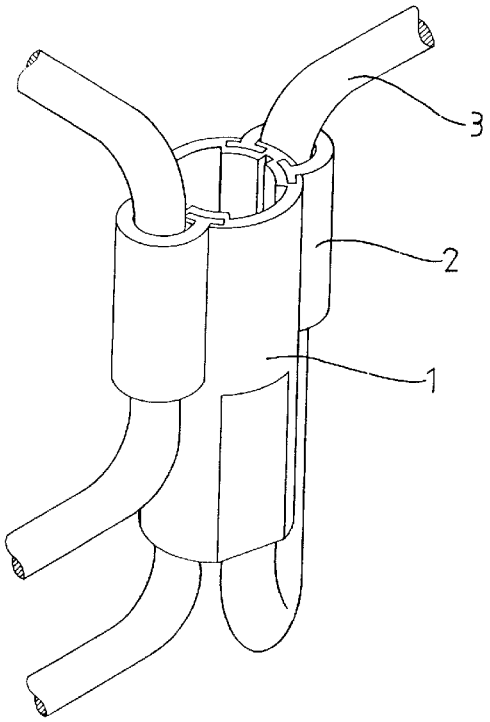
FIG. 2 is a solid view of the present invention.
Figure 3:
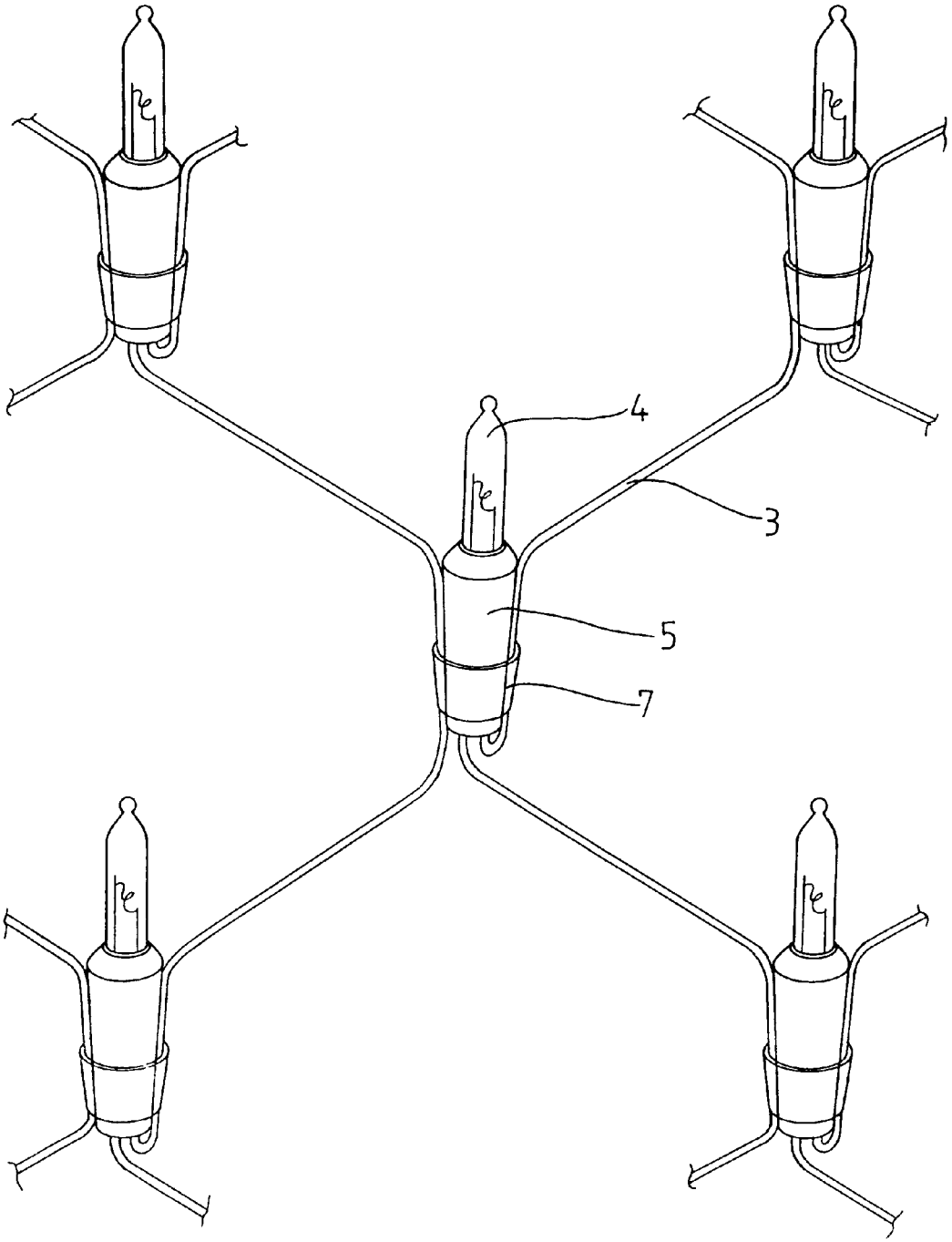
PRIOR ART FIG 3
FIG. 3 is a solid view of the first prior art.
Figure 4:
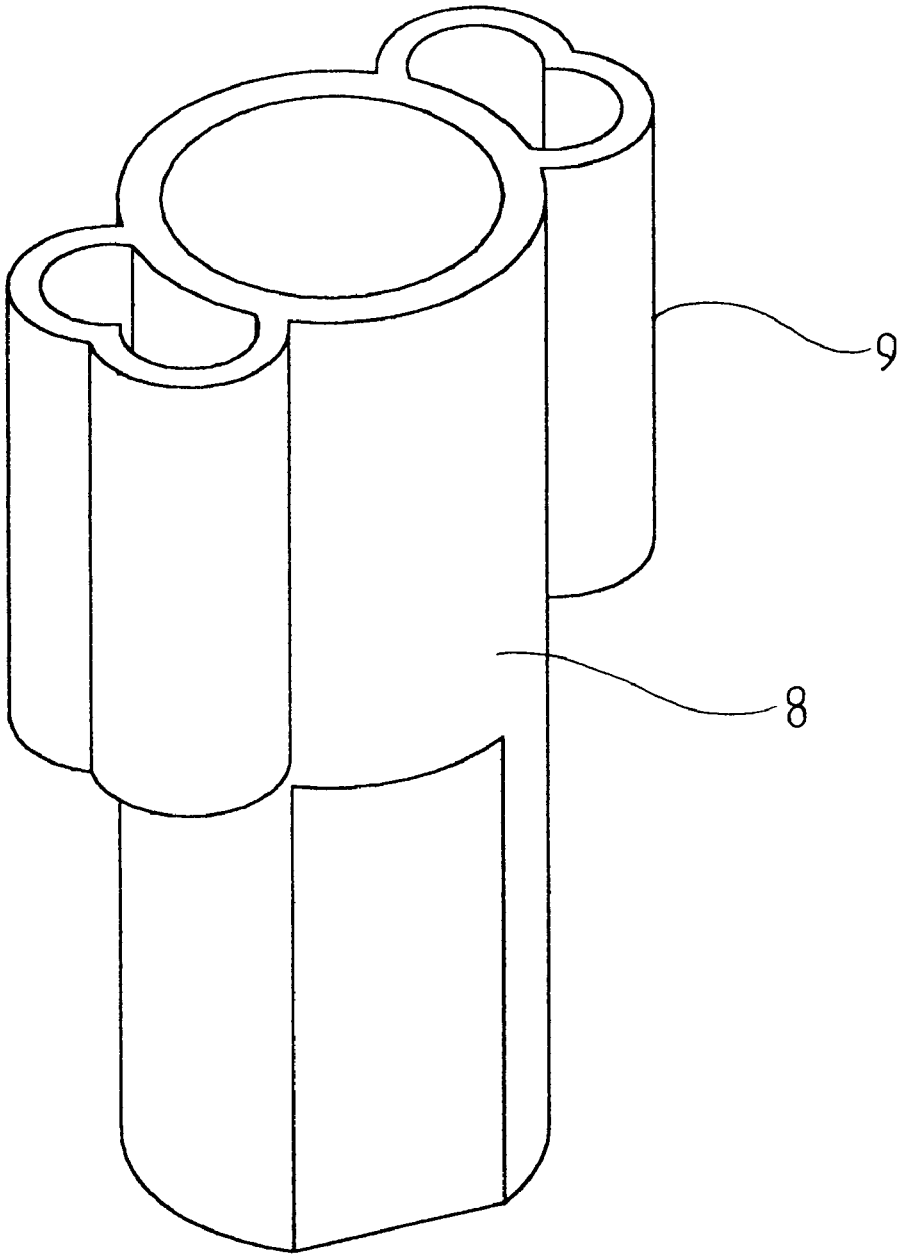
PRIOR ART FIG 4
FIG. 4 is a solid view of the second prior art.

Referring to FIG. 1 and FIG. 2, the present invention includes a lamp-holder 1 and two U-shaped lugs 2, wherein the lamp-holder 1 has two opposite pairs of T-shaped sliding slots 11, coordinating this, the U-shaped lug 2 has both T-shaped pegs 21 at the open end, in which the open distance of the both pegs 21 is bigger than the distance between the two T-shaped sliding slots 11 slightly.

As fixing the cord 3 on the lamp-holder 1, by means of the open end of the U-shaped lug 2, the cord 3 is put into the inner portion 22 of the U-shaped lug 2, then press two open ends of the U-shaped lug 2 closing to each other with fingers, attached on the lamp-holder 1 by sliding into the T-shaped sliding slots 11 with the said T-shaped pegs 21. When the U-shaped lug 2 get into desired place, it can be located in the T-shaped sliding slots 11 automatically by restoring force.

I claim:

1. A lamp-holder device for decorative network lighting including a lamp-holder and two U-shaped lugs, wherein the lamp-holder has two opposite pairs of T-shaped sliding slots, each of the U-shaped lugs having at least a pair of end portions formed substantially as T-shaped pegs insertable in the T-shaped sliding slots.

2. A lamp-holder device for decorative network lighting as in claim 1, wherein adjacent ones of the T-shaped pegs of each of the U-shaped lugs are spaced one from the other by a distance greater than a distance defined between the two T-shaped sliding slots of each pair of the T-shaped sliding slots of the lamp-holder.

* * * * *